US005375737A

United States Patent [19]

Ficken

[11] Patent Number: 5,375,737

[45] Date of Patent: Dec. 27, 1994

[54] VEND DOOR ASSEMBLY

[75] Inventor: Leonard A. Ficken, Ballwin, Mo.

[73] Assignee: Unidynamics Corporation, Stamford, Conn.

[21] Appl. No.: 128,386

[22] Filed: Sep. 29, 1993

[51] Int. Cl.[5] ..... B65H 3/00

[52] U.S. Cl. ..... 221/194; 109/48

[58] Field of Search ..... 221/194, 195, 191, 247, 221/248, 289, 96; 109/45–49, 53–55, 59 R, 22, 23; 232/47, 52, 48

[56] References Cited

U.S. PATENT DOCUMENTS

| | | | |
|---|---|---|---|
| 733,651 | 7/1903 | Hunter | 232/49 |
| 1,120,865 | 12/1914 | Tomaszewski | 232/49 |
| 1,841,926 | 1/1932 | Zuehl | 221/75 |
| 1,885,165 | 11/1932 | Willems | 109/19 |
| 1,907,850 | 5/1933 | Mertel | 109/48 |
| 2,968,422 | 1/1961 | Watlington | 221/194 |
| 2,977,023 | 3/1961 | Meyer | 221/205 |
| 3,702,101 | 11/1972 | Moore | 109/19 |
| 3,957,173 | 5/1976 | Roundebush | 221/15 |
| 4,823,984 | 4/1989 | Ficken | 221/96 |
| 4,940,161 | 7/1990 | Hieb | 221/194 |
| 5,131,797 | 7/1992 | Christiansen et al. | 414/219 |

*Primary Examiner*—Kenneth W. Noland

*Attorney, Agent, or Firm*—Senninger, Powers, Leavitt & Roedel

[57] ABSTRACT

A vend door assembly for a vending machine from which articles are selected from a supply area and then deposited into a common vending area of the vending machine and which provides a customer access opening through which articles can be removed. It includes a delivery compartment mounted for pivotal movement between a receiving position in which articles are received through an opening therein from the article supply area, and an article retrieving position in which the opening therein is pivoted and aligned with the customer access opening in the vending area so that a customer can remove the articles from the delivery compartment. It further includes an anti-pilferage door which is mounted coaxially with the delivery compartment for pivotal movement between a first position in which it allows articles to be deposited in the delivery compartment and a second position in which it blocks access to the supply of articles through the customer access opening in the vending machine and the opening in the delivery compartment, when a delivery compartment is in its retrieving position.

10 Claims, 9 Drawing Sheets

VEND DOOR ASSEMBLY

BACKGROUND OF THE INVENTION

1. Field of the Invention

The present invention relates to vending machines, and more particularly, to a vend door assembly for use therein.

2. Prior Art

Vending machines of the general type to which the present invention relates generally have a plurality of article storage areas from which individual articles can be selected and deposited in a common delivery area from which they can be removed by a customer. The delivery areas take many forms in the prior art, but are essentially compartments into which a customer can reach to retrieve the selected article. Although the compartment can be open, it is common, for example, to provide a hinged door or a sliding door which covers the opening and must be displaced in order for the customer to remove his chosen article. In addition, because of the increase in attempts to pilfer such machines, it has become necessary to provide some form of anti-pilferage device, such as a sheet metal flap which is moved into position between the delivery area and the article storage area, at least while the access door is open to permit the customer to retrieve his article while blocking access to the article storage area. Such anti-pilferage devices prevent an individual from reaching through the delivery compartment up into the article storage area with a wire or some other device to attempt to dislodge other articles and cause them to drop into the delivery area where they can be retrieved.

Because of the need for such anti-pilferage devices and the need for a door covering the delivery area, it is necessary that the delivery compartment be formed deeper than would otherwise be necessary, in order to allow the door to be swung open above articles deposited therein without engaging them. Because of the current desire to vend larger products, the use of such prior art arrangements has become a limitation on the size of articles which may be dispensed from the vending machines because of the limited space for expanding the depth of the delivery compartment in the lower portion of the machine while expanding the customer access opening sufficiently to allow retrieval of larger articles.

In addition, due to the complexity of the door operating mechanisms and anti-pilferage flap operating mechanisms, they have become an undesirably expensive and complicated portion of the vending machine.

SUMMARY OF THE INVENTION

The present invention overcomes the above-described difficulties and disadvantages associated with prior art vending machine vend door assemblies, by providing a vend door assembly, including an anti-pilferage device, which operates simply and inexpensively and takes up less room while providing a larger delivery area than do the prior art devices. These advantages over vend door assemblies of prior art vending machines are accomplished through the use of a delivery compartment positioned in the vending area into which articles are supplied from an article storage area and from which a customer can remove an article, and which compartment is mounted for pivotal movement between an article receiving position in which articles are received through the opening therein from the supply of articles and in which it covers the customer access opening in the vending area of the vending machine so as to block access to the compartment by a customer when in this position, and an article retrieving position in which the opening in the delivery compartment is aligned with the customer access opening of the vending machine so that an article in the compartment may be removed by a customer. The vend door assembly also includes an anti-pilferage door which is mounted coaxially with the delivery compartment for pivotal movement between a first position in which it is aligned with the delivery compartment so as to allow articles to be deposited from the article storage area into the delivery compartment when the delivery compartment is in its article receiving position, and a second position in which it is disposed so as to block access to the supply of articles in the article storage area through the customer access opening in the vending machine and the opening in the delivery compartment when the delivery compartment is in its retrieving position. A mechanism is also provided for pivoting the delivery compartment between its receiving and retrieving positions and for pivoting the anti-pilferage door between its first and second positions.

The delivery compartment of the vend door assembly is preferably generally cylindrical and mounted for pivotal movement about its horizontally disposed central access, and the anti-pilferage door is preferably arcuate and mounted inside and coaxially with the delivery compartment for pivotal movement. The delivery compartment and anti-pilferage door are preferably interconnected so as to be moved simultaneously. Movement of the delivery compartment between its receiving and retrieving positions is preferably accomplished through the use of a handle mounted to the delivery compartment which permits a customer to manually operate the vend door assembly to retrieve the selected article.

DETAILED DESCRIPTION OF THE PREFERRED EMBODIMENTS

Figure 1:
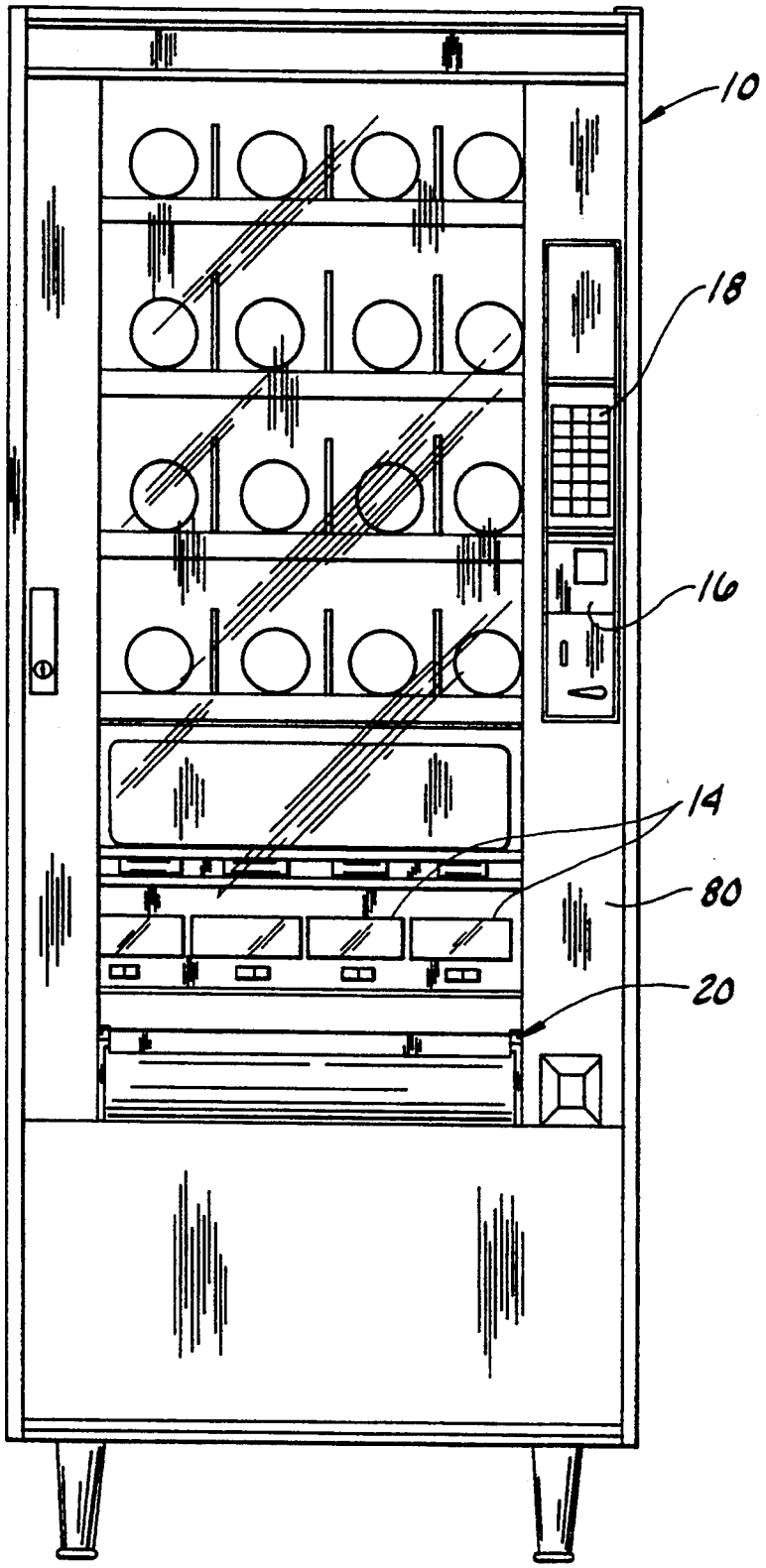
FIG. 1 is a front elevational view of a typical vending machine in which the vend door assembly of the present invention is illustrated.

An example of a vending machine 10 of the general type to which the present invention pertains and in which it can be utilized, is shown in FIG. 1. Such a machine is disclosed, for example, in U.S. Pat. No. 4,730,750. The vending machine 10 is shown having an article supply area containing spiral vendors 12 each of which can dispense a separate article, and a plurality of can or bottle dispensers 14 which can, likewise, dispense individual articles. It is to be understood, however, that the vending machine 10 can be of any type which dispenses to a common receiving or delivery area and that the present invention is not intended to be limited to the specific vending machine illustrated herein. Such vending machines 10 have a coin or monetary operating control mechanisms, illustrated generally at 16, and a selection means 18, such as a keypad which, through a central processing unit (not shown) operates the individual article supply mechanism, such as the spiral vendors 12 or can or bottle dispensers 14, in a well known manner.

A first embodiment of the vend door assembly of the present invention, shown generally as 20, is shown in FIG. 1 positioned in the lower front portion of the vending machine 10, in what is referred to herein as the vending area, where it can be easily accessed by a customer.

Figure 2:
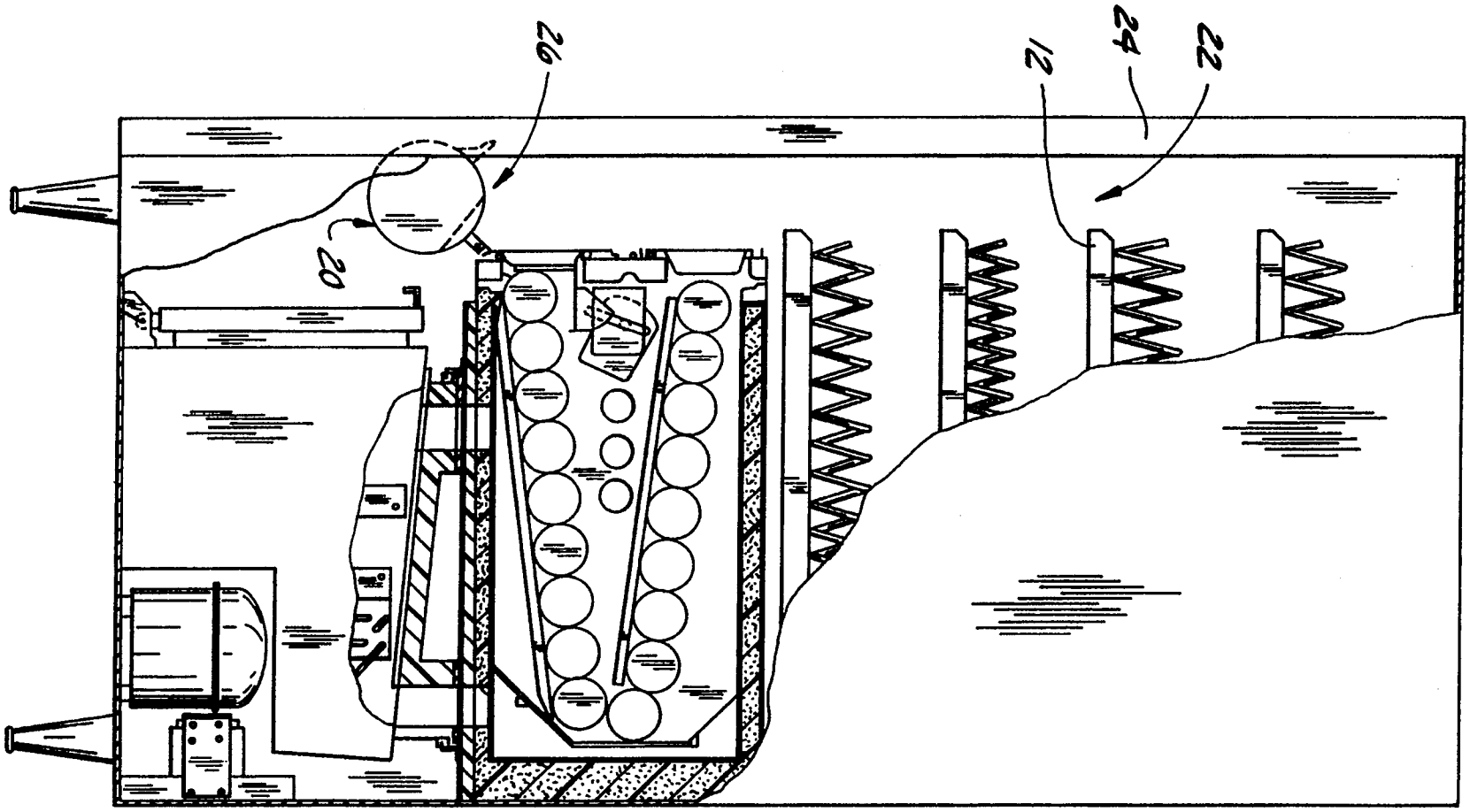
FIG. 2 is a side view of the embodiment of FIG. 1 partially cutaway showing the spiral vendors and can or bottle dispensers therein.
Figure 3:
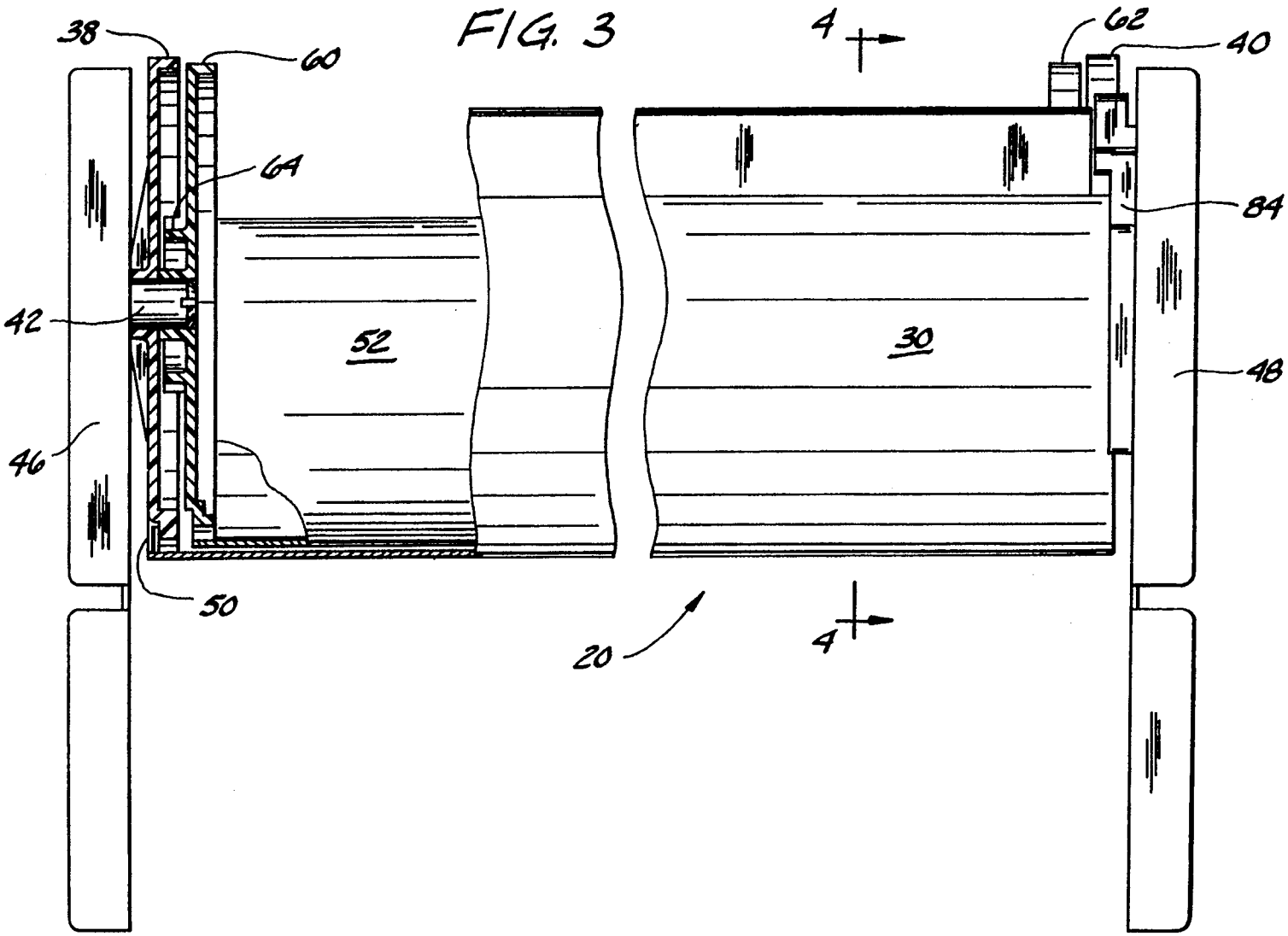
FIG. 3 is an enlarged front view of a first preferred embodiment of the vend door assembly removed from the vending machine.

As illustrated in FIG. 2, inside the vending machine 10 there is a space 22 extending the height of the article supply area between the ends of the spiral vendors 12 and the inside back surface of the front service door 24 of the vending machine 10, which permits articles to fall from the ends of each of the spiral vendors 12 or the can or bottle dispensers 14 into a trough 26 where it is directed to the vend door assembly 20 of the present invention, in the common delivery area. The trough 26, in the vending machine 10 illustrated is merely a plurality of deflector plates, described below, which prevent articles being dispensed from the spiral vendors 12 or can or bottle dispensers 14 from becoming lodged in internal portions of the vending machine. Thus, the trough 26 directs the selected articles into the common vending area and thus into the vendor assembly 20 of the present invention.

Figure 4:
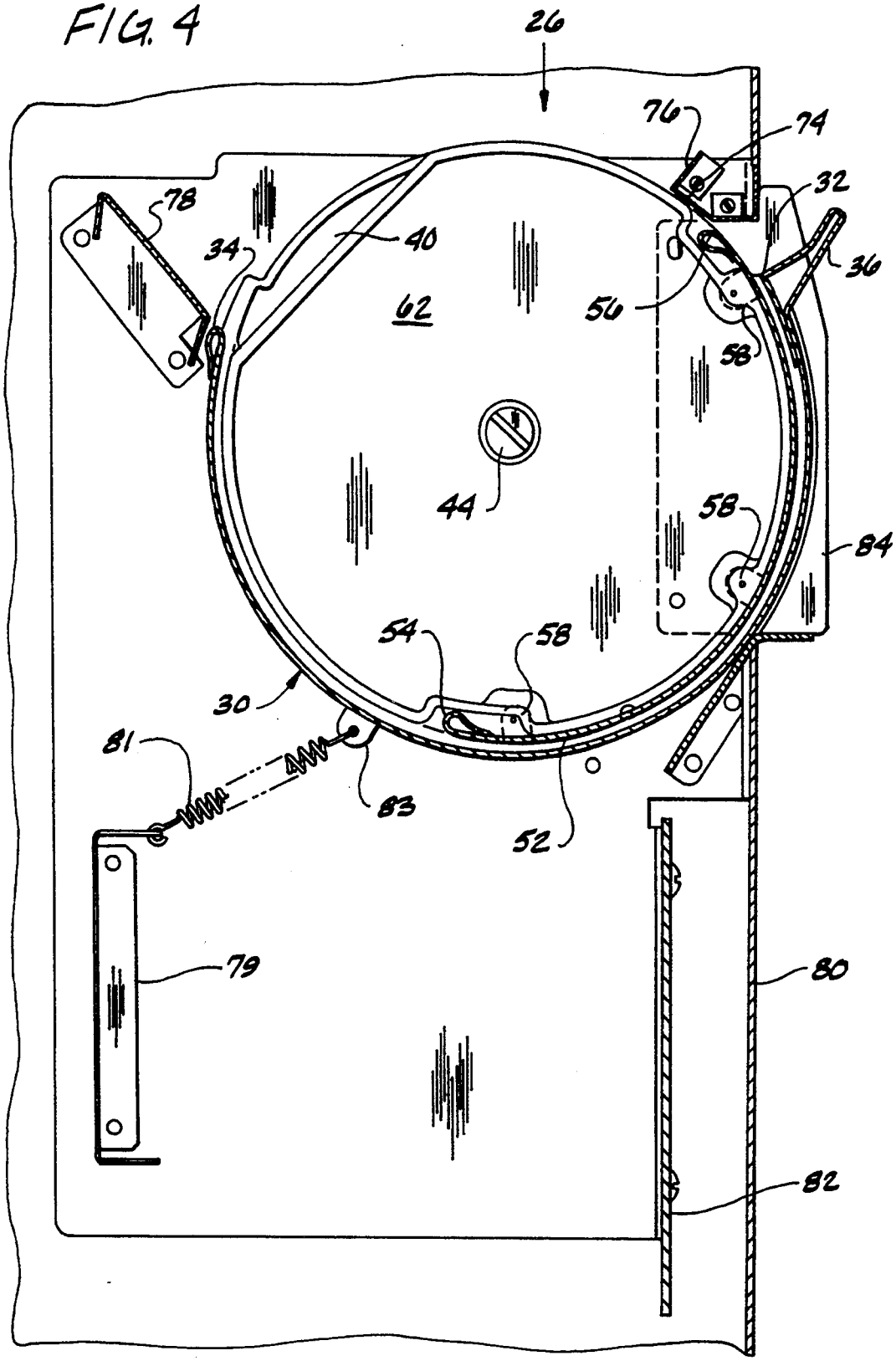
FIG. 4 is a cross-sectional view in the direction of line 4—4 of FIG. 3.

Referring now to the construction of the first preferred embodiment of the vend door assembly 20, as best seen in FIGS. 3–6, a delivery compartment 30 is provided of generally cylindrical shape with an axially extending opening therein defined by the edges 32 and 34, as seen in FIG. 4, and extending the entire length of the compartment 30. Delivery compartment 30 is preferably made of sheet metal and a sheet metal handle 36 is formed and welded to delivery compartment 30 along the edge 32 which provides strength to that edge of the compartment 30. Edge 34 is rolled backwards along its length to lend strength to that edge of the compartment 30. Attached at each end of the delivery compartment 30 are generally disc shaped caps 38 and 40 which are mounted for rotation about their central axis by pins 42 and 44 to the frame members 46 and 48, respectively, of the vend door assembly 20. The sheet metal delivery compartment 30 is fastened at its ends to caps 38 and 40 by a series of tabs 50, such as by screws. Thus, the delivery compartment 30 is mounted for rotation about its central axis within the frame members 46 and 48.

Figure 5:
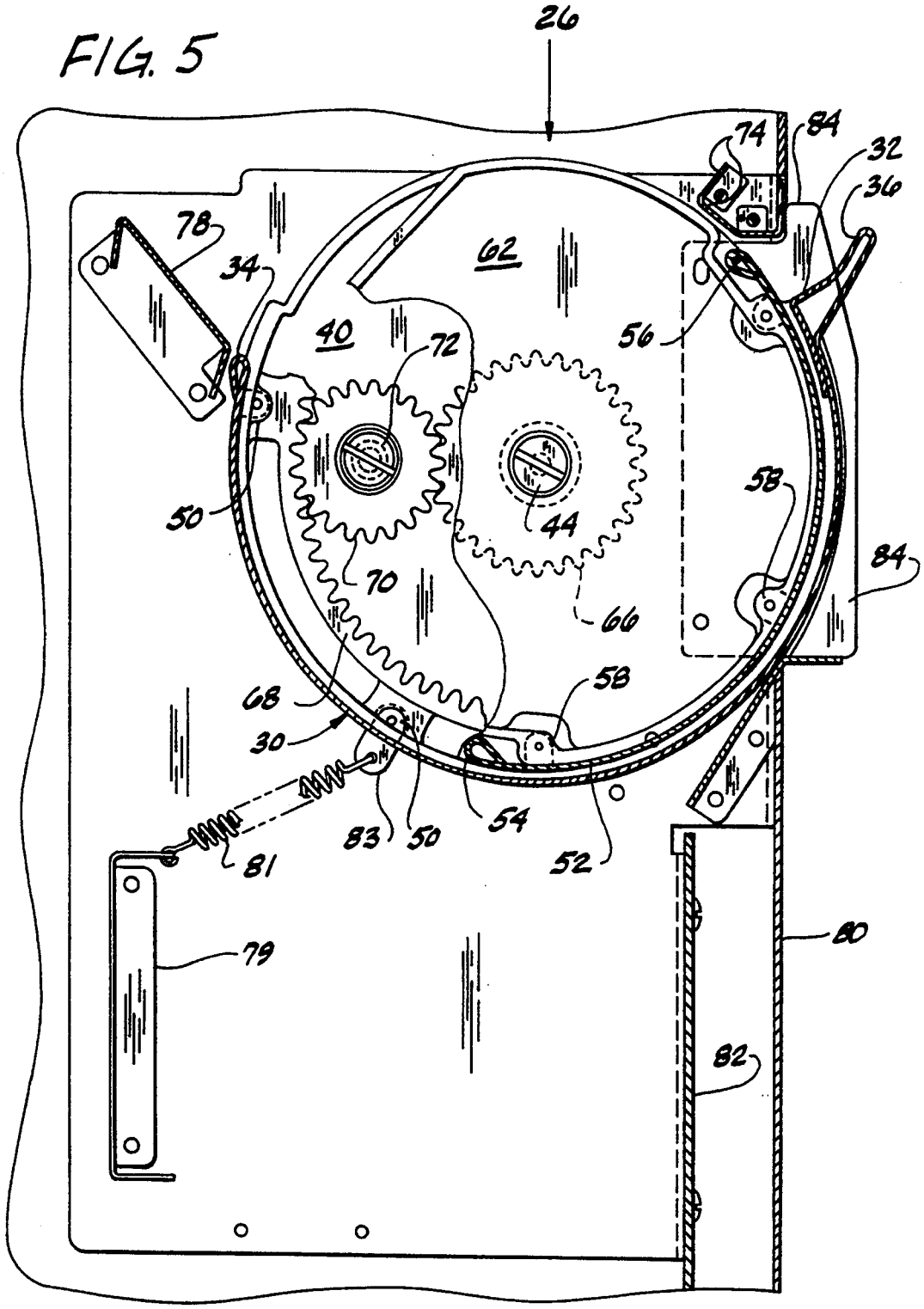
FIG. 5 is a view similar to FIG. 4 with a portion of the anti-pilferage door end plate cutaway for viewing the gear arrangement therein.
Figure 6:
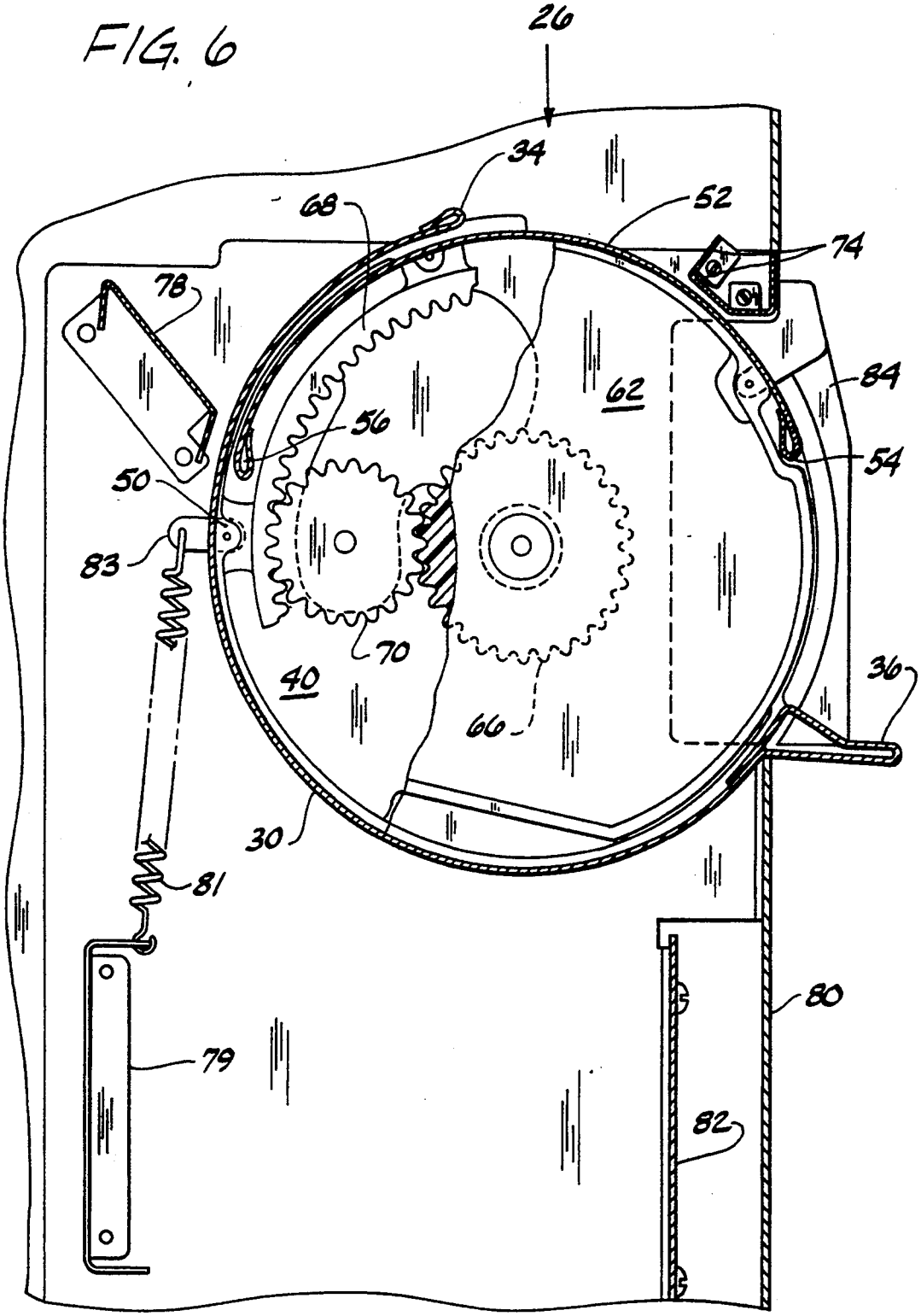
FIG. 6 is a view similar to FIG. 5 showing the delivery compartment and anti-pilferage door moved to the retrieving position for access by a customer.

Disposed within the delivery compartment 30 and mounted for rotation about the same axis as the delivery compartment 30, is an anti-pilferage door 52. Anti-pilferage door 52 is also preferably made of sheet metal and has its edges 54 and 56 rolled to strengthen the door. Like delivery compartment 30, anti-pilferage door 52 is mounted at its ends by a series of tabs 58 to a pair of disc-shaped end caps 60 and 62 which are mounted inboard of disc-shaped caps 38 and 40 on their central axes for pivotal movement independent of caps 38 and 40. Thus, the anti-pilferage door 52 rotates about the same axis as the delivery compartment 30 and is disposed within the compartment 30. Formed in the end caps 60 and 62 are a pair of driven gears 64 and 66, respectively, which are formed coaxial with the axis of rotation of the anti-pilferage door 52. A sector gear, such as 68 in FIG. 5, is formed in each of the end caps 38 and 40 of delivery compartment 30. Pinion gears, such as gear 70, are mounted by pins 72 for rotation to respective side frames 46 and 48 extending between the respective sector gears 68 and driven gears 64 and 66 of the end caps 60 and 62. Thus, as handle 36 is moved clockwise, as viewed in FIGS. 4 and 5, the gear train, made of sector gear 68, pinion gear 70 and driven gear 66, causes counterclockwise rotation of the anti-pilferage door 52, as does the similar gear train on the opposite end of vend door assembly 20. In the first preferred embodiment, the gear ratio between the three gears is such that 60° of delivery compartment 30 rotation creates 144° of anti-pilferage door 52 rotation. These movements correspond to the full range of movement of the handle 36 from its fully up position, as shown in FIGS. 4 and 5, to its fully down position, as shown in FIG. 6.

As shown in FIGS. 4 and 5, both the delivery compartment 30 and anti-pilferage door 52 are in their normal rest positions. In this position, the opening in compartment 30 formed by the edges 32 and 34 is disposed upwardly to receive articles vended from either the vendors 12 or the can and bottle dispensers 14. The upper end 56 of the anti-pilferage door 52, extends upwardly beyond the handle 36, covering that portion of the customer access opening in the front of the machine not covered by the delivery compartment 30, and is out of the area of the trough 26 so that articles will fall from the article supply and storage area into the delivery compartment 30. The end 56 of anti-pilferage door 52 preferably extends immediately adjacent the trough 26, as shown in FIGS. 4 and 5, so as to be disposed against the bracket 74 that extends along the length of the opening in the delivery compartment 30, so as to reduce the possibility of pilfering by minimizing the space between the bracket 74 and the end 56 of anti-pilferage door 52. The upper edge 76 of bracket 74 acts as part of the trough 26 to direct product into the delivery compartment 30. Bracket 74 extends between the main side frames 46 and 48 of the vend door assembly 20. A similar bracket 78 extends between the frame members 46 and 48 at the rear portion thereof adjacent the upper edge 34 of delivery compartment 30 and, likewise, acts as a portion of the trough 26 to deflect articles into the delivery compartment 30.

As shown in FIGS. 4 and 5, the vend door assembly 20 is mounted as a unit to the inside of the hinged front service door 80 to a sheet metal interior mounting plate 82 secured to the door for movement therewith so that the vend door assembly 20 is pivoted outwardly with the service door 80 when the interior of the machine 10 is being serviced, such as when new articles are being placed in the spiral vendors 12 or can and bottle dispensers 14. A pair of plastic end caps, such as 84, are mounted to respective frame members 46 and 48 and cover the end caps 38, 40 and 60 and 62 to assist in preventing pilferaging by eliminating possible openings through which a wire might be fed up into the article storage and supply area. A further bracket 79 extends between the frame members 46 and 48 in the lower rear portion thereof to provide a stiffening support for the vend door assembly 20 frame structure. Attached at one end to the bracket 79 is an extension spring 81 which is attached at its other end to a bracket 83 fastened to compartment 30, as shown in FIGS. 4, 5 and 6, which helps urge the compartment closed from its open position shown in FIG. 6.

Referring now to the manner of operation of the first preferred embodiment of vend door assembly 20, as the customer deposits his coins in the coin mechanism 16 and makes his article selection through the keypad 18, the desired article is vended, either from the spiral dispensers 12 or can and bottle dispensers 14, and is dropped by gravity through the trough area 26 and through the opening defined by edge 34 of delivery compartment 30 and edge 56 of anti-pilferage door 52 into the delivery compartment 30. The customer then pushes downward on handle 36 causing pivotal movement of delivery compartment 30, clockwise as viewed in FIGS. 4–6. As delivery compartment 30 pivots, sector gear 68 causes clockwise rotation of the intermediate gear 70 which, in turn, causes counterclockwise rotation of the driven gear 66. Since driven gear 66 is secured to end cap 62, it causes counterclockwise rotation of anti-pilferage door 52. As previously described, the same gear train exists on the opposite end of the delivery door assembly 20. When the door handle 36 is moved from the position illustrated in FIG. 4 to its lower most position, as illustrated in FIG. 6, the delivery compartment opening defined by edges 32 and 34 is moved from its vertical receiving position to its substantially horizontal article retrieving position. Through the same motion of handle 36, the anti-pilferage door 52 is moved by the two gear trains from its first retracted position, where it lies inside the front opening of the machine, to its second position, as shown in FIG. 6, where it closes off the opening through trough 26 while permitting the customer to retrieve the article from the front customer access opening of the machine 10.

Figure 7:
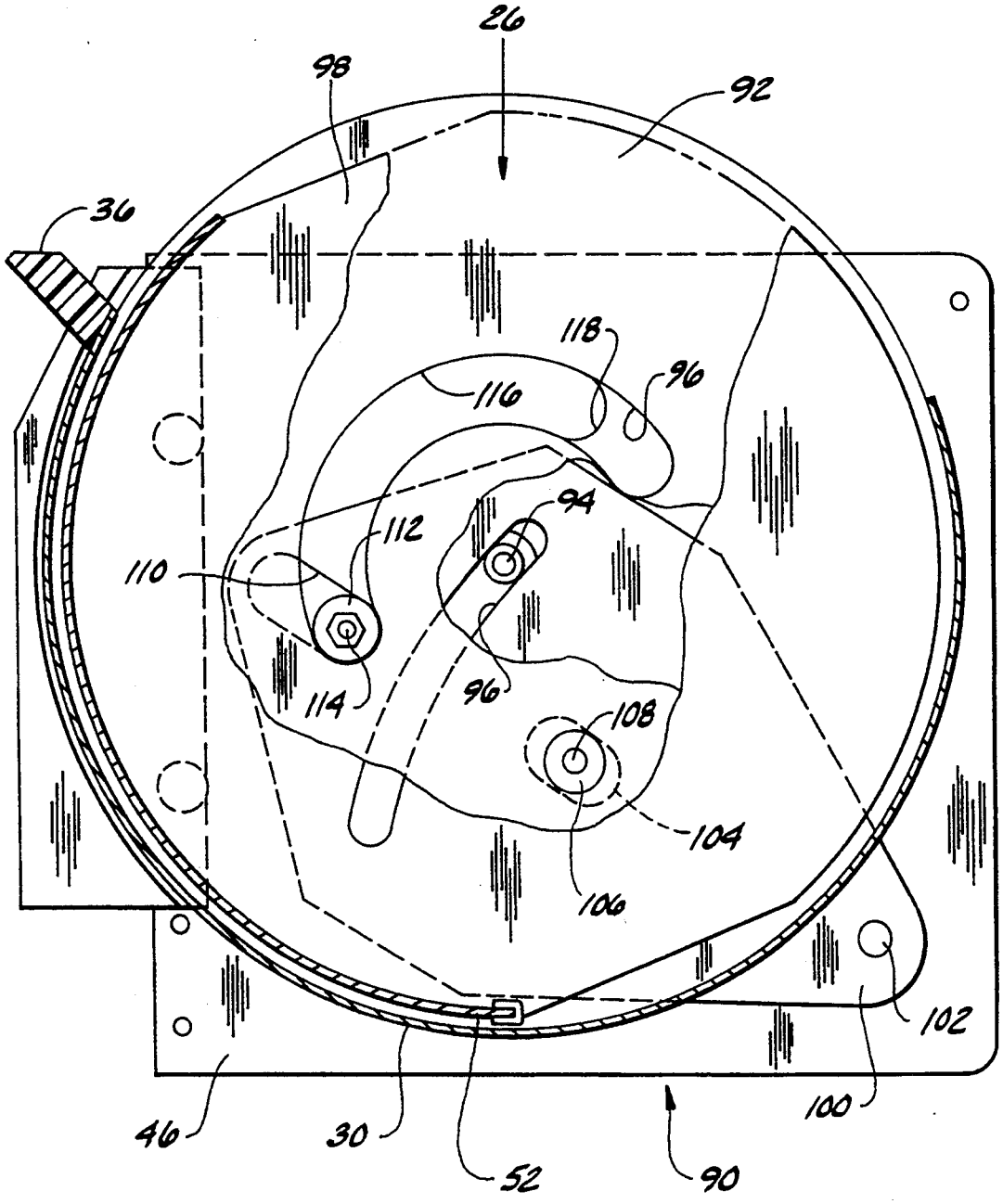
FIG. 7 is a cross-sectional view similar to FIG. 4, but of a second preferred embodiment of the vend door assembly and of the opposite end thereof from that shown in FIG. 4 and with partially cutaway end plates for viewing the camming plates therein.
Figure 8:
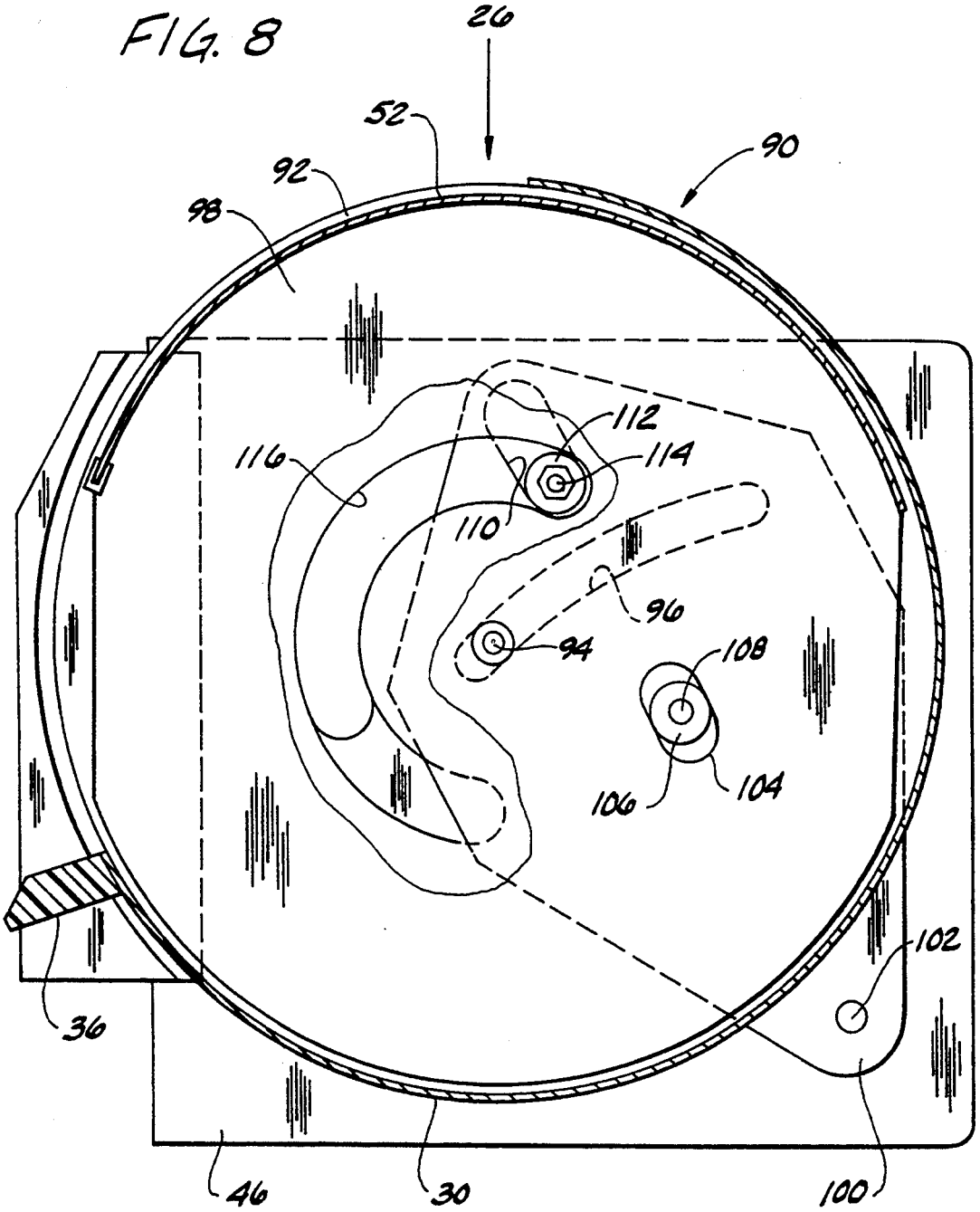
FIG. 8 is a view similar to FIG. 7 with the delivery compartment and anti-pilferage doors moved to the retrieving position.
Figure 9:
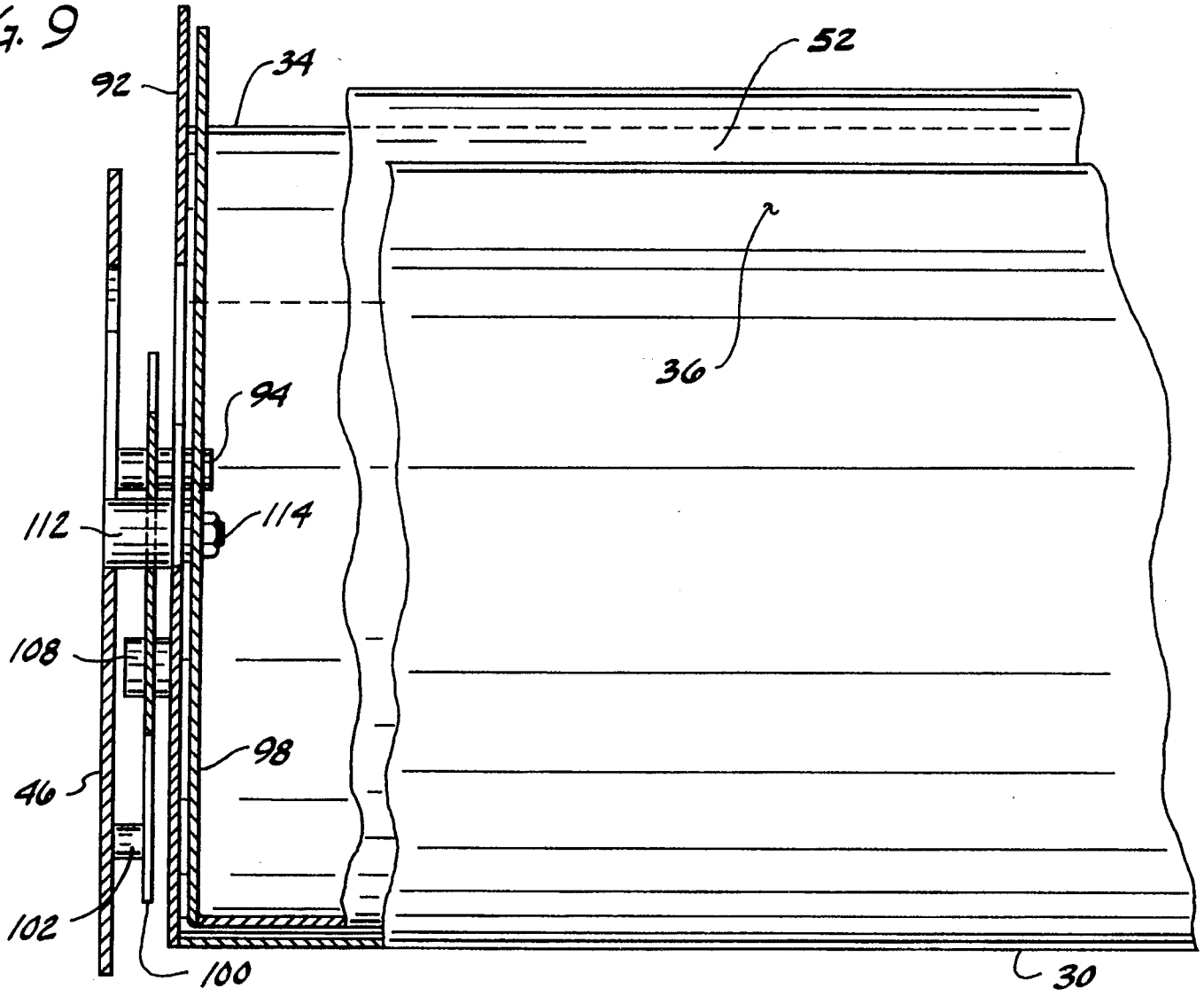
FIG. 9 is a cross-sectional view through an end portion of the delivery door shown in FIG. 8.

Referring now to the alternative embodiment of the vend door assembly 20, as shown in FIGS. 7–9, the construction is essentially the same as previously described for the first embodiment with the exception of the mechanism which causes relative rotation between the delivery compartment 30 and anti-pilferage door 52. Therefore, only those components which differ significantly from the previously described embodiment will be explained below. Furthermore, a section of only one end of the vend door assembly 90 is shown with the opposite end being a mirror image thereof.

The vend door assembly 90 essentially uses camming mechanisms in place of the gear train of vend door assembly 20 in order to cause the counter-rotation between the delivery compartment 30 and the anti-pilferage door 52. As shown in FIG. 7, the end plate 92 is mounted for pivotal movement on a central axis through pin 94 which is secured, such as by bolting, to side frame 46. A radiused slot 96 forming a camming surface is defined in end plate 92. An end plate 98 is secured at the end of anti-pilferage door 52 and is disposed inboard of the delivery compartment end plate 92, as shown in FIG. 7–9. Disposed between the frame member 46 and end plate 92 is a crank arm 100 which is pivotally supported by a pin 102 secured to frame member 46. A first slot 104 is formed in the crank arm 100 and is engaged by a roller 106 mounted for rotation by pin 108 to the delivery compartment end plate 92. A second slot 110 is formed in crank arm 100 and receives a roller 112 which is mounted for rotation by pin 114 to the anti-pilferage door end plate 98. As can best be seen in FIG. 9, roller 112 extends through the radial slot 96 in the delivery compartment end plate 92 and through a further radial slot 116 defined in the frame member 46 and which has its lower most end co-incident with the slot 96, but is shorter than the slot 96, with its opposite upper end portion 118 being shown in FIG. 7.

Referring now to the manner of operation of the second vend door assembly 90, and referring to FIGS. 7–9, as the handle 36 is pushed downwardly by a customer, as shown in FIG. 7, this causes counterclockwise rotation of the delivery compartment 30 to which handle 36 is attached, and roller 106, which is secured to the end plate 92, is moved radially counterclockwise causing pivotal movement of crank arm 100 in the clockwise direction, as illustrated in FIG. 7. As the crank arm 100 moves clockwise, it is guided by pin 94 which rides in slot 96. A clockwise pivoting of crank arm 100 causes roller 112 to move upperwardly through the arcuate slots 96 and 116 and thus causes the anti-pilferage door 52 to move clockwise since roller 112 is secured to its end plate 98. The distance from the pivot point 102 of crank arm 100 to rollers 106 and 112 and the position of their respective receiving slots, produces essentially the same relative pivotal movement between the delivery compartment 30 and anti-pilferage door 52 as in the previously described embodiment so that as the handle 36 is moved to its lower most position, as shown in FIG. 8, the anti-pilferage door 52 is moved upwardly to a position beneath the trough 26, thus allowing access to the delivery compartment 90 while preventing a customer from accessing the article storage area through the trough 26.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A vend door assembly for use in a vending machine from which articles are selected from a supply and then deposited in a common vending area of the vending machine providing a customer access opening through which the article can be removed by a customer, comprising:

a delivery compartment having an opening therein and mountable in the vending area for pivotal movement between an article receiving position in which articles are received through the opening therein from the supply of articles and in which it covers the customer access opening in the vending area of the vending machine so as to block access to the compartment by a customer when in this position, and an article retrieving position in which the opening therein is aligned with the customer access opening in the vending area of the vending machine so that an article in the compartment may be removed by a customer;

an anti-pilferage door mountable coaxially with the delivery Compartment for pivotal movement between a first position in which it is aligned with the delivery compartment for pivotal movement bedeposited in the delivery compartment from the article supply when the delivery compartment is in its article receiving position, and a second position in which it blocks access to the supply of articles through the customer access opening in the vending machine and the opening in the delivery compartment when the delivery compartment is in its retrieving position;

means for pivoting the delivery compartment between its receiving and retrieving positions and for pivoting the anti-pilferage door between its first and second positions;

wherein the articles are delivered from the article supply to the delivery compartment through a trough formed in the vending machine and the anti-pilferage door covers the trough when in its second position; and wherein the anti-pilferage door is disposed adjacent to the opening in the vending area and inside the delivery compartment when the delivery compartment is disposed in its receiving position.

2. A vend door assembly for use in a vending machine from which articles are selected from a supply and then deposited in a common vending area of the vending machine providing a customer access opening through which the article can be removed by a customer, comprising:

a delivery compartment having an opening therein and mountable in the vending area for pivotal movement between an article receiving position in which articles are received through the opening therein from the supply of articles and in which it covers the customer access opening in the vending area of the vending machine so as to block access to the compartment by a customer when in this position, and an article retrieving position in which the opening therein is aligned with the customer access opening in the vending area of the vending machine so that an article in the compartment may be removed by a customer;

an anti-pilferage door mountable coaxially with the delivery compartment for pivotal movement between a first position in which it is aligned with the delivery compartment so as to allow articles to be deposited in the delivery compartment from the article supply when the delivery compartment is in its article receiving position, and a second position in which it blocks access to the supply of articles through the customer access opening in the vending machine and the opening in the delivery compartment when the delivery compartment is in its retrieving position;

means for pivoting the delivery compartment between its receiving and retrieving positions and for pivoting the anti-pilferage door between its first and second positions; and wherein the delivery compartment is generally cylindrical with an axially extending opening therein and is mountable for pivotal movement about its horizontally disposed central axis and the anti-pilferage door is arcuate and mountable inside and coaxially with the delivery compartment for pivotal movement.

3. A vend door assembly as defined in claim 2 wherein the means for pivoting the delivery compartment and anti-pilferage door pivots them simultaneously.

4. A vend door assembly as defined in claim 3 wherein the means for pivoting further includes a handle on the delivery compartment for manually pivoting the delivery compartment between its receiving and retrieving positions, and a gear train means interengaging the delivery compartment and the anti-pilferage door so as to cause each to pivot in the opposite direction from the other when the handle is moved.

5. A vend door assembly as defined in claim 3 wherein the means for pivoting further includes a handle on the delivery compartment for manually pivoting the delivery compartment between its receiving and retrieving positions, and a cam means interengaging the delivery compartment and anti-pilferage door so as to cause each to pivot in the opposite direction from the other when the handle is moved.

6. A vend door assembly as defined in claim 2, including means biasing the delivery compartment towards its article receiving position.

7. In a vending machine having a coin controlled operating mechanism, a plurality of article storage and supply mechanisms from which articles are selected by a selection means and then deposited through a trough formed in the vending machine into a common vending area of the vending machine which provides a customer access opening in the front of the vending machine through which a selected article can be removed by a customer, the improvement comprising a vend door assembly disposed in the vending area and having:

a substantially cylindrical delivery compartment disposed with its axis horizontally and having an axially extending opening therein and mounted for pivotal movement between an article receiving position in which articles are received through the opening therein from the supply of articles through the trough and in which it covers the customer access opening the vending area of the vending machine so as to block access to the compartment by a customer, and an article retrieving position in which the opening therein is aligned with the customer access opening the vending area of the vending machine so that an article in the compartment may be removed by a customer;

an arcuate anti-pilferage door mounted coaxially with the delivery compartment for pivotal movement between a first position remote from the trough and in which it allows articles to be deposited from the article supply through the trough into the delivery compartment when the delivery compartment is in its article receiving position, and a second position covering the trough and in which it blocks access to the supply of articles through the customer access opening in the vending machine and the opening in the delivery compartment when the delivery compartment is in its retrieving position;

means for pivoting the delivery compartment between its receiving and retrieving positions and for pivoting the anti-pilferage door between its first and second positions; and wherein the means for pivoting the delivery compartment and anti-pilferage door does so simultaneously.

8. The improvement as defined in claim 7 wherein the means for pivoting further includes a handle on the delivery compartment for manually pivoting the delivery compartment between its receiving and retrieving positions, and a gear train means interengaging the delivery compartment and the anti-pilferage door so as to cause each to pivot in the opposite direction from the other when the handle is moved.

9. The improvement as defined in claim 7 wherein the means for pivoting further includes a handle on the delivery compartment for manually pivoting the delivery compartment between its receiving and retrieving positions, and a cam means interengaging the delivery compartment and the anti-pilferage door so as to cause each to pivot in the opposite direction from the other when the handle is moved.

10. The improvement as defined in claim 7, including means biasing the delivery compartment towards its article receiving position.

* * * * *

UNITED STATES PATENT AND TRADEMARK OFFICE

CERTIFICATE OF CORRECTION

PATENT NO. : 5,375,737

DATED : December 27, 1994

INVENTOR(S) : Leonard A. Ficken

It is certified that error appears in the above-identified patent and that said Letters Patent is hereby corrected as shown below:

Column 7, claim 1, line 5, "delivery Compartment" should read ---delivery compartment---.

Column 7, claim 1, lines 7-8, "compartment for pivotable movement be deposited" should read ---compartment so as to allow articles to be deposited---.

Signed and Sealed this

Twenty-fifth Day of April, 1995

*Attest:*

*Attesting Officer*

BRUCE LEHMAN

*Commissioner of Patents and Trademarks*